United States Patent [19]

Sabatini

[11] 4,106,427

[45] Aug. 15, 1978

[54] ALARM SYSTEM

[76] Inventor: Charles L. Sabatini, P.O. Box 458, Spring Lake, N.J. 02762

[21] Appl. No.: 775,830

[22] Filed: Mar. 9, 1977

[51] Int. Cl.[2] ..... G08B 13/08

[52] U.S. Cl. ..... 116/90; 116/93

[58] Field of Search ..... 116/85, 86, 90, 91, 116/93, 100

[56] References Cited

U.S. PATENT DOCUMENTS

| | | | |
|---|---|---|---|
| 344,871 | 7/1886 | Schmidt | 116/91 |
| 635,332 | 10/1899 | Malloy | 116/90 |
| 709,331 | 9/1902 | Kinzy | 116/85 |
| 817,437 | 4/1906 | McGowan | 116/100 |
| 2,486,139 | 10/1949 | Feldman | 116/93 |
| 3,714,922 | 2/1973 | Da Silva | 116/86 X |

*Primary Examiner*—James J. Gill

*Attorney, Agent, or Firm*—Allison C. Collard

[57] ABSTRACT

An alarm system for detecting and signaling the unauthorized opening of a movable closure, includes a support plate, a toothed rack, slidably supported on the support plate, a gear, rotatably mounted on the support plate and, in mesh with the teeth of the rack, spring means and a level arm coupled to the gear, and a bell mounted on the support plate. The alarm system is self-powered and is mechanically actuated by opening of the closure. The system is reset automatically by closing the movable closure.

3 Claims, 6 Drawing Figures

FIG. 1
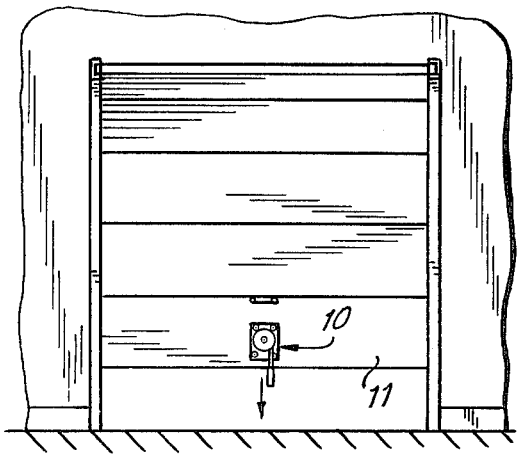
FIG. 2
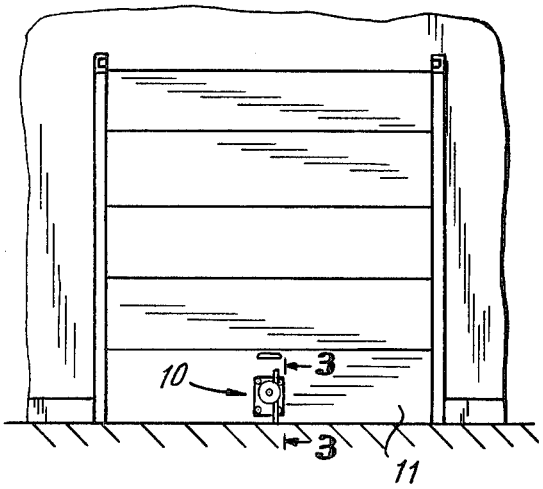
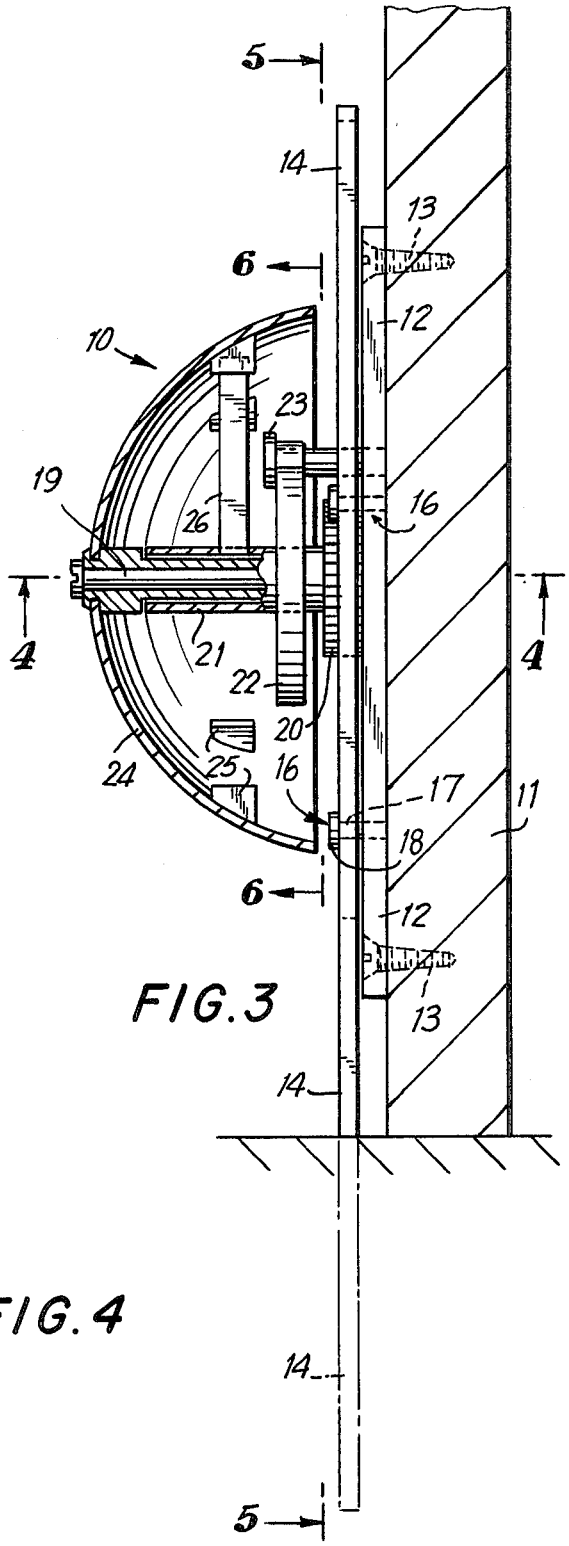
FIG. 3
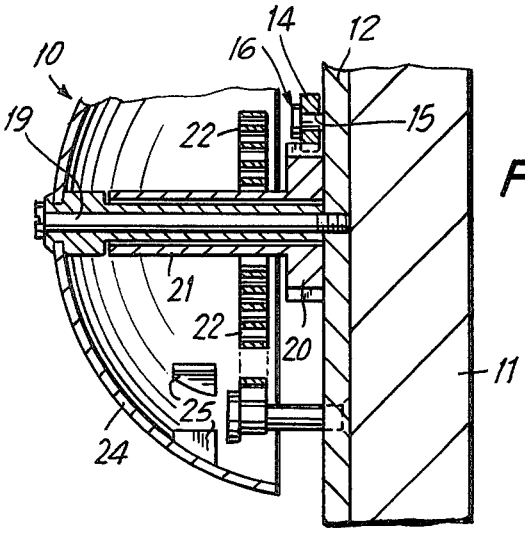
FIG. 4

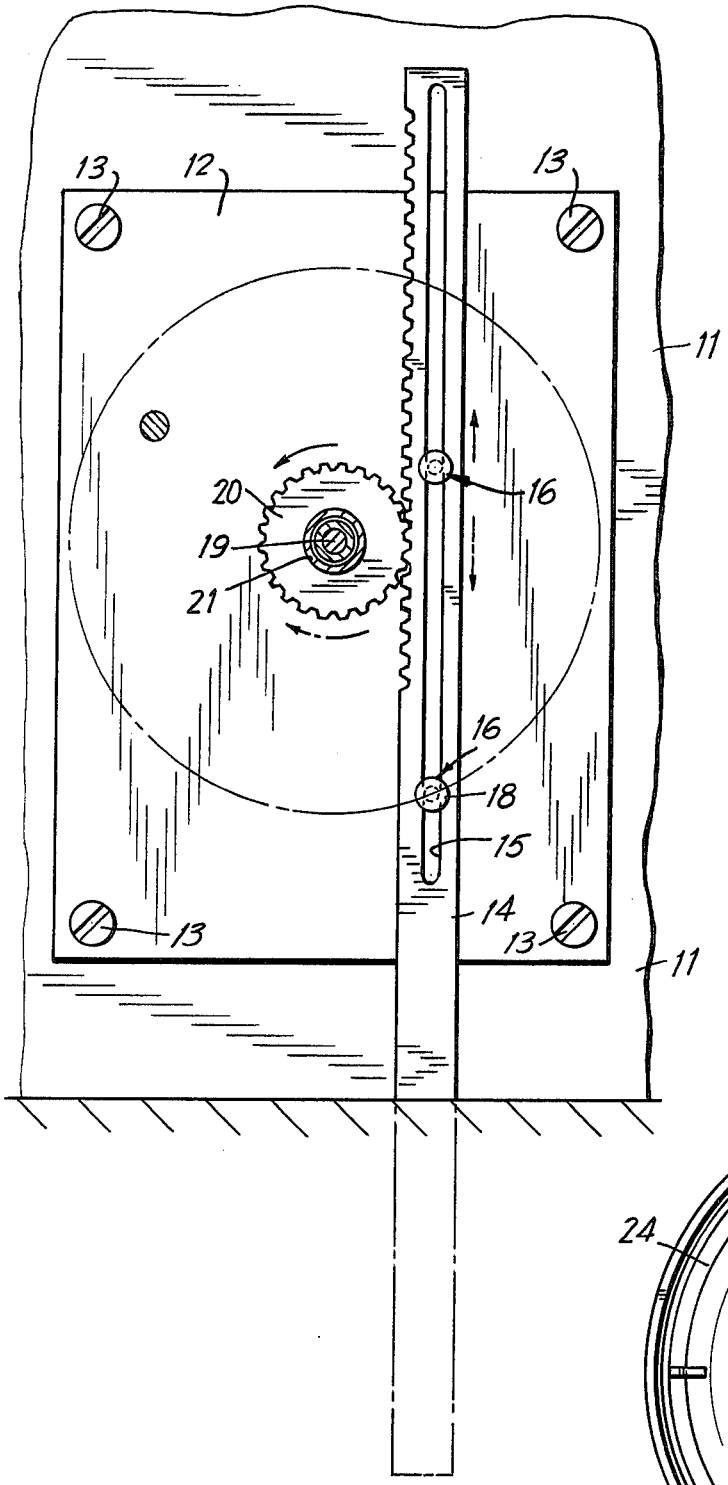
FIG. 5
FIG. 6
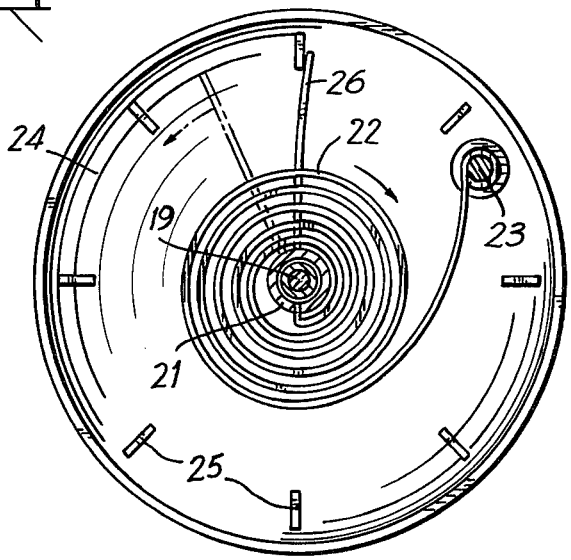

ALARM SYSTEM

BACKGROUND OF THE INVENTION

This invention relates to an alarm system and, more particularly, to a mechanically-operated, self-powered, automatic alarm system for detecting and signaling the opening of door, window or other movable closure.

Alarm systems for detecting the unauthorized opening of movable closures, such as garage doors, windows, etc., are, of course, well known in the art. However, such prior art mechanisms have tended to have certain drawbacks, e.g., undue expense and complexity, the need for electrical wiring and a power supply, the use of non-standardized and specially fabricated parts, excessive space requirements, and difficult installation. While attempts have been made to improve upon the above-noted deficiencies, so far as is known, no presently-available alarm system affords the advantages of that of the instant invention, nor deals with the aforementioned problems in an entirely satisfactory and sufficiently simple manner.

Accordingly, it is an object of the present invention to provide a novel alarm system for detecting and signaling the unauthorized opening of movable closures.

It is also an object of the invention to provide such alarm system which is compact, and of relatively simple design, and which is economical, durable, reliable, easily installed and convenient to use.

It is a further object of the invention to provide such an alarm system which is self-powered, automatic and mechanically-operated.

It is a more particular object of this invention to provide such an alarm system having the foregoing attributes and characteristics which may be fabrically made from readily available, commercially-standardized parts.

SUMMARY OF THE INVENTION

It has now been found that certain of the foregoing and related objects are readily attained in an alarm system which includes a support plate, a toothed rack slidably supported on the support plate for longitudinal reciprocable movement, a gear rotatably mounted on the support plate and in mesh with the teeth of the rack, and a resilient lever arm which is coupled to the gear for rotation therewith. The system also includes spring means coupled to the gear which biases the gear against rotation in a first direction, and a bell mounted on the support plate, which has an interior surface from which inwardly project a plurality of spaced abutments, the abutments being disposed in the path of a portion of the level arm for striking engagement therewith.

Preferably, the spring means comprises a flat, spiral spring having an inner end which is secured to the gear and an outer end which is fixed to the support plate. Most desirably, the support plate has at least two space-apart guide pins mounted thereon, and the toothed rack has a longitudinally-extending slot formed therein, the guide pins being received within the slot of the rack.

In the particularly preferred embodiments, the support plate has an upstanding arbour mounted thereon, the outer end of which supports the bell, and the gear has a coaxially-disposed, hollow cylindrical sleeve secured thereto, which is rotatably supported on the arbour. In addition, the inner end of the spring and the inner end of the lever arm are most advantageously secured to the sleeve. Generally, the bell has a dome-shaped configuration and the system additionally includes means for mounting the system on or adjacent a movable closure.

BRIEF DESCRIPTION OF THE DRAWINGS

FIG. 1 is a front elevation view of the novel alarm system, embodying the present invention, mounted on a garage door, showing the lower position of the rack when the door is opened;

FIG. 2 is a view similar to that of FIG. 1, drawn to the same scale, but showing the door fully closed and the rack in its upper position;

FIG. 3 is an enlarged side elevational view of the alarm system taken along line 3—3 of FIG. 2, shown partly in section, which also shows, in phantom line, the lower position of the rack;

FIG. 4 is a fragmentarily-illustrated, cross sectional view, taken along line 4—4 of FIG. 3;

FIG. 5 is a front elevation view taken along line 5—5 of FIG. 3, with portions of the alarm system broken away to show the internal construction below the bell housing; and FIG. 6 is a rear elevation view taken along line 6—6 of FIG. 3, with portions of the alarm system broken away to show the internal construction within the bell housing.

DETAILED DESCRIPTION OF THE ILLUSTRATED EMBODIMENT

Turning now in detail to the appended drawings, therein illustrated is a novel alarm system embodying the present invention, generally designated by the numeral 10, which as best seen in FIGS. 1 and 2, is mounted adjacent to the lower end of a garage door 11. As seen more clearly in FIGS. 3 and 5, the alarm system includes a generally rectangular support plate 12, which is secured to the garage door by four screws 13.

A generally rectangular, elongated toothed rack 14 which has a longitudinally extending slot 15 formed therein, is slidably supported on the support plate 12 by means of a pair of rivet-shaped guide pins, generally designated by the numeral 16. The guide pins 16, which are mounted at spaced location on the support plate 12, have shank portions 17 which are received within the slot 15 of the rack 14 and flattened head portions 18 which prevent disengagement of the rack 14 from the plate 12. The guide pins 16 are spaced at a suitable distance from one another so as to allow longitudinal reciprocation of the rack 14 between an upper and lower position, in the latter position of which the rack 14 projects beyond the lower edge of the plate 12 and the garage door 11 (the purpose for which will be described in detail hereafter).

An arbour or post 19 is mounted on the support plate 12 and extends outwardly and normally therefrom. A gear 20, from which upwardly extends a coaxially disposed, hollow cylindrical sleeve or collar 21, is rotatably supported on the arbour 19 and is disposed for meshing engagement with the teeth of the rack 14. As seen more clearly in FIG. 6, secured to the collar 21 of the gear 20 is the inner end of a flat spiral spring 22, the outer end of which is anchored by means of a rivet-shaped pin 23, to the support plate 12. The convolutions of the spring 22 project radially outwardly in a clockwise direction (oppposite that shown in FIG. 6,) so that counterclockwise rotation of the gear 20 will wind or tighten the spring 22, i.e., descreasing the outside diameter of the convoluted spring to thereby place it in tension.

A generally dome-shaped hollow bell 24 is mounted on the outer end of the arbour 19. As seen in FIG. 6, the bell 24 has eight equidistantly-spaced abutments 25 projecting from its interior surface, which are directed radially inwardly toward the sleeve 21. A generally rectangular, flat, resilient lever arm 26 is secured to the sleeve 21 and extends radially outwardly therefrom. The lever arm 26, which serves as a clapper for the bell 24, is disposed at a suitable height on the collar 21 such that as the collar 21 is rotated, the outer end of the lever arm 26 will successively strike the abutments 25 of the bell 24, thus sounding the alarm.

As shown in FIG. 1, when the garage door 11 is open, the rack 14 projects below the bottom edge of the door 11 and, at this point, the spring 22 is relaxed. However, when the door 11 is lowered, the bottom end of the rack 14 will strike the ground initially, halting further downward movement thereof; the slidable mounting of the rack 14 on the plate 12, permitting further lowering and closing of the door 11. Thus, following contact of the rack 14 and the ground and, as a result of the meshing engagement of the teeth of the rack 14 with that of the gear 20, as the door continues to be lowered, the gear 20 will be rotated in a counterclockwise direction and, in turn, will wind the spring 22.

Consequently, when the door 11 is fully closed (FIGS. 2 and 3,) the spring 22 is fully wound and the alarm system is set; the engagement of the gear 20 with the temporarily restrained rack 14 (now in its upper position,) preventing release of the spring 22, and activation of the alarm.

Thereafter, when the door 11 is opened, the progressive release of the rack 14 from contact with the ground, permits unwinding of the spring 22 which, in turn, causes clockwise rotation of the gear 20 and lever arm 26. As the lever arm 26 is rotated, its outer end will successively strike the abutments 25 on the interior surface of the bell 24, thus sounding the alarm. As can be appreciated, the alarm will be automatically reset upon reclosing of the door 11.

While the instant alarm system has been described in relation to the illustrated and preferred embodiment, it should be understood that modifications may be made, as will be apparent to those skilled in the art. For example, while the alarm system has been shown in use in connection with a sliding garage door, it may, of course, be used with other movable closures or partitions, such as hinged doors, windows, desk drawers, etc. In addition, it should be appreciated that the alarm system need not be mounted on the movable closure, but instead, may be mounted on a closure frame, so long as an abutment surface on the closure itself is provided for the bottom of the rack. Finally, it should be appreciated that the dimensions and configurations and dispositions of the alarm system and its various elements may be substantially modified, so long as the manner of operation is not substantially altered.

Thus, it can be seen that the present invention provides a novel alarm system for detecting and signaling the unauthorized opening of movable closures. The alarm system is compact, of relatively simple design and is economical, durable, reliable, easily installed and convenient to use. In addition, the system is self powered, automatic and mechanically operated. The alarm system may also be fabricated from readily available, commercially-standardized parts.

What is claimed is:

1. An alarm system for detecting and signaling the opening of a movable closure comprising:

a support plate having at least two spaced-apart guide pins and an upstanding arbour mounted thereon;

a toothed rack having a longitudinally extending slot formed therein slidably supported on said support plate for longitudinal reciprocable movement, said guide pins of said support plate being received within said slot of said rack;

a gear rotatably mounted on said support plate and in mesh with the teeth of said rack, said gear having a coaxially-disposed, hollow cylindrical sleeve, secured thereto, which is rotatably supported on said arbour;

a resilient lever arm having an inner end which is coupled to said sleeve for rotation therewith;

spring means coupled to said gear which biases said gear against rotation in a first direction, said spring means comprising a flat, spiral spring, having an inner end which is fixed to said sleeve and an outer end which is fixed to said support plate; and a bell mounted on the outer end of said arbour, said bell having an interior surface from which inwardly project a plurality of spaced abutments, said abutments being disposed in the path of a portion of said level arm for striking engagement therewith.

2. The system as recited in claim 1 wherein said bell has a generally dome-shaped configuration.

3. The system as recited in claim 1 additionally including means for mounting said system on or adjacent to a movable closure.

* * * * *